US008061364B2

(12) United States Patent
Park

(10) Patent No.: US 8,061,364 B2
(45) **Date of Patent: *Nov. 22, 2011**

(54) DOUBLE-ENDED DRY NAIL POLISH APPLIQUE FOR COATING A WIDE RANGE OF FINGERNAIL SIZES

(75) Inventor: Fa Young Park, Leonia, NJ (US)

(73) Assignee: Park Global Holdings, LLC, Leonia, NJ (US)

( * ) Notice: Subject to any disclaimer, the term of this patent is extended or adjusted under 35 U.S.C. 154(b) by 555 days.

This patent is subject to a terminal disclaimer.

(21) Appl. No.: 12/183,385

(22) Filed: Jul. 31, 2008

(65) Prior Publication Data

US 2008/0283073 A1 Nov. 20, 2008

Related U.S. Application Data

(63) Continuation-in-part of application No. 12/138,701, filed on Jun. 13, 2008, which is a continuation-in-part of application No. 11/866,678, filed on Oct. 3, 2007, which is a continuation-in-part of application No. 11/543,481, filed on Oct. 5, 2006, which is a continuation-in-part of application No. 11/126,862, filed on May 11, 2005.

(60) Provisional application No. 60/570,713, filed on May 12, 2004.

(51) Int. Cl.
*A45D 29/00* (2006.01)

(52) U.S. Cl. ..... 132/73

(58) Field of Classification Search ..... 132/73, 132/200, 285
See application file for complete search history.

(56) References Cited

U.S. PATENT DOCUMENTS

| | | | | | |
|---|---|---|---|---|---|
| 2,162,155 | A | * | 6/1939 | Calvin | 132/73 |
| 2,688,331 | A | * | 9/1954 | Bogoslowsky | 132/73 |
| 2,816,555 | A | * | 12/1957 | Klump | 132/73 |
| 3,993,084 | A | * | 11/1976 | Cullen | 132/73 |
| 4,903,840 | A | * | 2/1990 | So | 206/581 |
| 4,947,876 | A | * | 8/1990 | Larsen | 132/73 |
| 5,415,903 | A | * | 5/1995 | Hoffman et al. | 428/15 |
| 5,525,389 | A | * | 6/1996 | Hoffmann et al. | 428/41.5 |
| 2004/0079381 | A1 | * | 4/2004 | Han | 132/73 |

FOREIGN PATENT DOCUMENTS

WO WO88/02226 * 4/1988

OTHER PUBLICATIONS

WO 88/02226 Richman, Edward Adhesive Fingernail Applique Apr. 7, 1988 whole document.*

* cited by examiner

*Primary Examiner* — Robyn Doan
(74) *Attorney, Agent, or Firm* — Levisohn Berger, LLP

(57) ABSTRACT

A nail appliqué product for applying dry nail polish to a fingernail. The appliqué has two ends—each of which is functionally useful for coating a fingernail. The two ends are each differently sized so that with each inventive appliqué a user is presented with two different choices of sizes to match to her particular fingernail. In one preferred embodiment, a buffer section also is provided to ensure that the functional and aesthetic integrity is preserved when the appliqué is removed from its backing.

5 Claims, 12 Drawing Sheets

DOUBLE-ENDED DRY NAIL POLISH APPLIQUE FOR COATING A WIDE RANGE OF FINGERNAIL SIZES

RELATED APPLICATIONS

The current application is a Continuation-In-Part of pending U.S. patent application Ser. No. 12/138,701 filed on Jun. 13, 2008, which is itself a Continuation-In-Part of pending U.S. patent application Ser. No. 11/866,678 filed on Oct. 3, 2007, which is a Continuation-In-Part of pending U.S. patent application Ser. No. 11/543,481 filed Oct. 5, 2006, which is itself a Continuation-In-Part of U.S. patent application Ser. No. 11/126,862, filed on May 11, 2005, which claims domestic priority from U.S. Provisional Patent Application No. 60/570,713, filed on May 12, 2004. The contents of each of the above-mentioned patent applications are incorporated by reference herein.

FIELD OF THE INVENTION

The current invention relates generally to the field of nail polish, more specifically, to a novel method and apparatus for attaining a manicure using an instant dry film nail polish application.

BACKGROUND OF THE INVENTION

The use of an instant fingernail coating product whereby nail polish is applied to a fingernail by adhesively securing to it a dry form of nail polish has become a preferred mode of attaining a manicure by many users. Such dry nail polish products are disclosed in U.S. Pat. Nos. 4,903,840 and 5,415,903 each of which is incorporated by reference herein.

The nail coating product, or instant nail polish referenced above, confers numerous advantages over conventional, prior art nail polish applied with a brush in a liquid form. The application of instant nail polish is faster, easier and cleaner than conventional nail polish and does not suffer from the numerous encumbrances associated with wet nail polish such as drying time and the concern of smearing or smudging As disclosed in the applications incorporated by reference herein, a single nail appliqué is substantially sized and shaped to match the surface of a fingernail. However, because nail size varies from person to person it is virtually impossible to design a single nail appliqué that will universally fit every fingernail. To address this problem, the instant inventor has provided multiple appliqués of varying size for each fingernail For instance, in a package of appliqués there will be two different appliqués for each finger—one of them being incrementally more slender than the other The problem with the above approach is that two sizes per fingernail did not adequately cover a broad range of nail sizes. As a result, the above-referenced nail product was unavailable to consumers with wider or narrower than average fingernails. To address this problem, one solution would be to provide yet additional sizes of appliqués per finger. However, this would make appliqués more expensive, and would require larger packaging and would as such disadvantageously affect both consumers who would be required to pay more per package and retailers who would have to stock and display larger packages A prior attempt to resolve this problem is disclosed in pending application Ser. No. 11/543,481. In that application, a nail appliqué is presented which has two ends—each of which is differently sized (see FIG. 17). As such, a single appliqué advantageously comprises two different sizes. In this manner, if two such sets of appliqués were included per package, there would be a total of four sizes per finger. Importantly, this doubling of potential nail sizes is achieved without a significant manufacturing expense and furthermore does not require larger sized packaging.

In the above-referenced two-sided appliqué, a handling tab is disposed midway between each end of the appliqué for selectively removing the appliqué from its backing. However, this arrangement suffers from numerous disadvantages. Firstly, the tab is difficult to grasp. Additionally, because the tab is directly connected to the functional portion of the nail coating, when stress is exerted on the tab in order to remove an appliqué the appliqué is often stretched, torn or otherwise deformed—thereby impairing its integrity and usefulness.

SUMMARY OF THE INVENTION

In light of the above, a double sided appliqué is anticipated which advantageously doubles the number of sizes of appliqués and is conveniently removable without disturbing its functional integrity.

The inventive nail appliqué comprises a single nail appliqué having two curved ends—each of a different curvature. Thus, because each end comprises a different curvature they are each adapted to coat two different sized fingernails.

A handling tab is disposed above the appliqué, which is continuous with a buffer area—and not with the nail coating itself. The nail coating portion of the appliqué is attached to the buffer zone by one or more slender strips of nail coating. As such, when a user pulls on the tab in order to remove an appliqué, stress is exerted on the attached buffer zone, thereby protecting the nail portion. Once the appliqué is successfully removed from its backing, it is easily separated from the buffer area without damaging the nail coating area.

The double-ended appliqué essentially comprises two appliqués positioned in a back-to-back orientation. The two rounded ends are the functional ends of the appliqué, whereas the middle area essentially comprises the back ends of each appliqué—excess area that is ultimately sheered off.

DETAILED DESCRIPTION OF THE INVENTION

Figure 1:
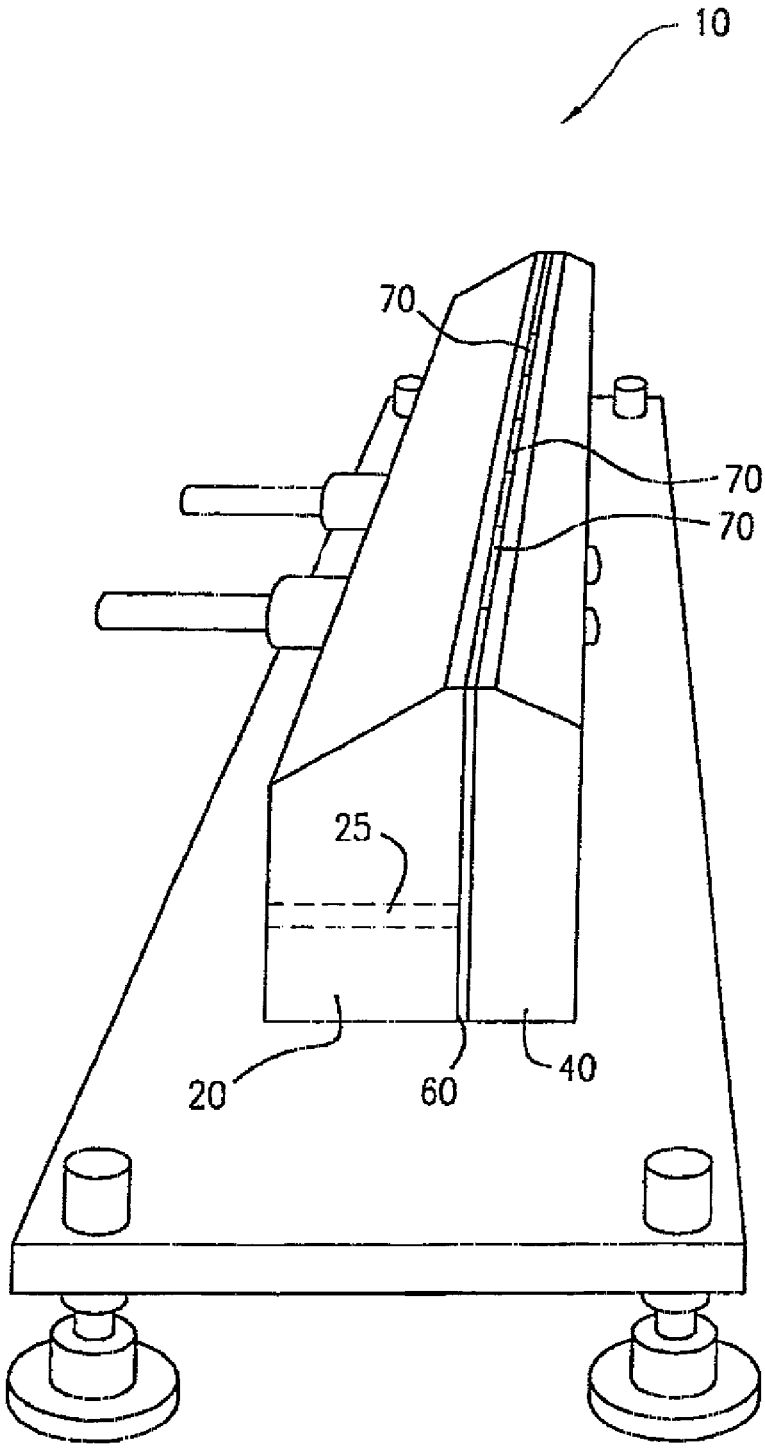
FIG. 1 is a bottom perspective view of a slot coating die used in the inventive method.
Figure 2:
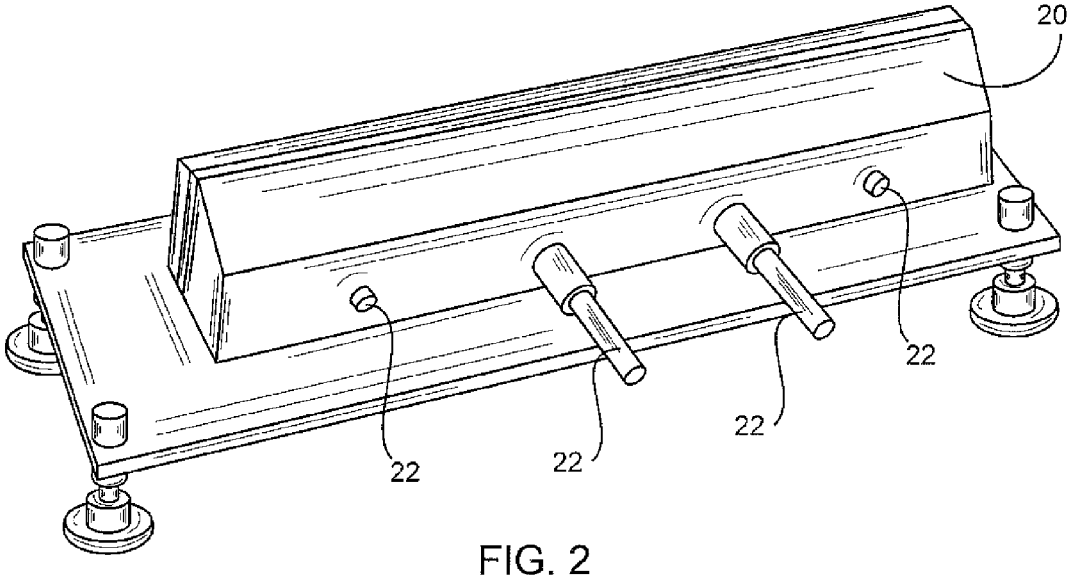
FIG. 2 front bottom perspective view of the slot coating die of FIG. 1
Figure 3:
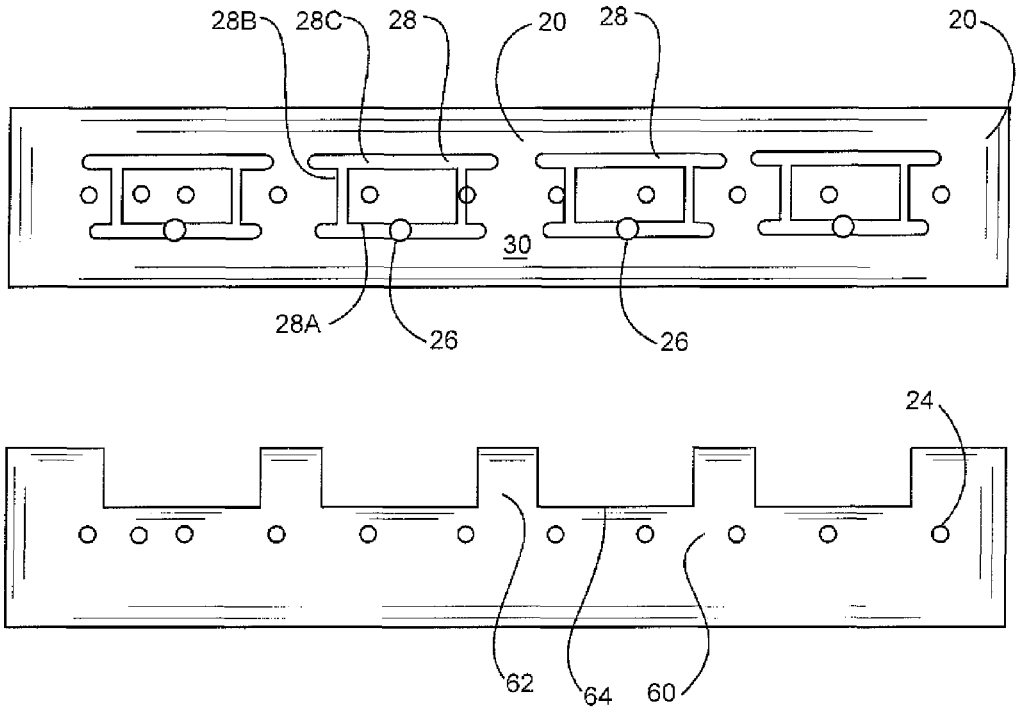
FIG. 3 is an elevational view of a shim and half of the slot coating die of FIG. 1 dissembled.
Figure 4:
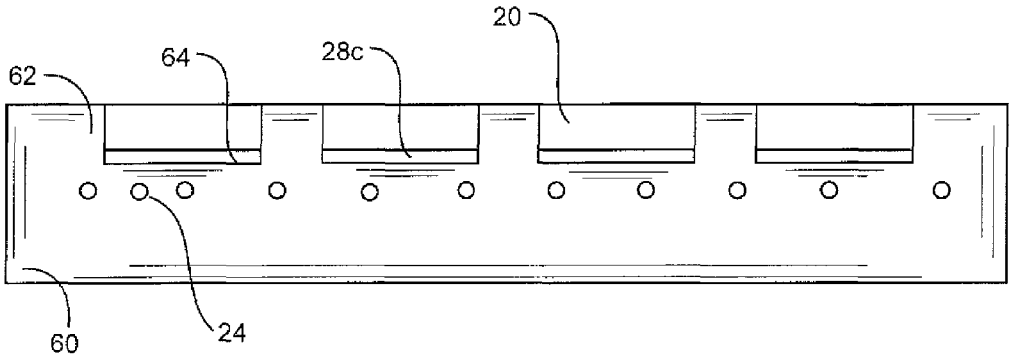
FIG. 4 is an elevational view of the shim and die half of FIG. 3 assembled.

The following is a detailed description of the preferred embodiments of the invention, reference being made to the drawings in which the same reference numerals identify the same elements of structure in each of the several figures. It should be noted that these drawings are merely exemplary in nature and in no way serve to limit the scope of the invention, which is defined by the claims appearing herein below The various coatings of the product are applied via a technique referred to herein as "slot curtain die coating." The die in question is shown in FIGS. 1-4 in various states of assembly as die 10. As best shown in FIG. 1, die 10 includes front die section 20, rear die section 40, and a specially shaped shim 60 disposed therebetween. All three parts are tightly secured together, preferably by bolting, e g, by bolts 24 (see FIG. 6). Referring to FIG. 2, front die section 20 includes inlets 22 which feed internal bores 25 with liquid nail enamel or any of the other components of the product, such as for example adhesive or a top, clear layer FIGS. 3 and 4 illustrate the interior of die 10; in both of these figures, rear die section 40 has been removed for clarity. Internal bores 25 of front die section 20 terminate in outlet holes 26 on inner face 30 and reside in flow channels 28 thereon. The purpose of flow channels 28 is to direct the liquid nail enamel from outlet holes 26 in a manner that results in consistent and even application of the enamel on the substrate. As such, each flow channel 28 includes upper substantially horizontal branch 28A, which feeds into substantially vertical branches 28B and thence into lower substantially horizontal branch 28C. It should be noted that die 10 is shown in FIGS. 1-4 upside down; hence, fluid exiting outlet hole 26 seeps along horizontal branch 28A, down vertical branches 28B, and then seeps into horizontal branch 28C. The liquid enamel seeps from branch 28C and onto the substrate.

Without shim 60, the two inner faces of front and rear die sections 20 and 40 would be firmly abutting and would not allow room for the enamel to seep out of horizontal branch 28C. However, as shown in FIGS. 3 and 4, shim 60 includes vertical projections 62 between cutouts 64. When shim 60 is attached to front die section 20 by bolts 24 (see FIG. 4), it shields and covers all of flow channel 28 except for the majority of lower horizontal branch 28C. This way, enamel flowing in branches 28A or 28B cannot seep out of these branches but must instead move forward (downward) ultimately to branch 28C. Because branch 28C is uncovered, enamel simply spills out of it and thus out of slots 70 (see FIG. 1) and onto the substrate in a sheet-like or curtain-like configuration.

Figure 5:
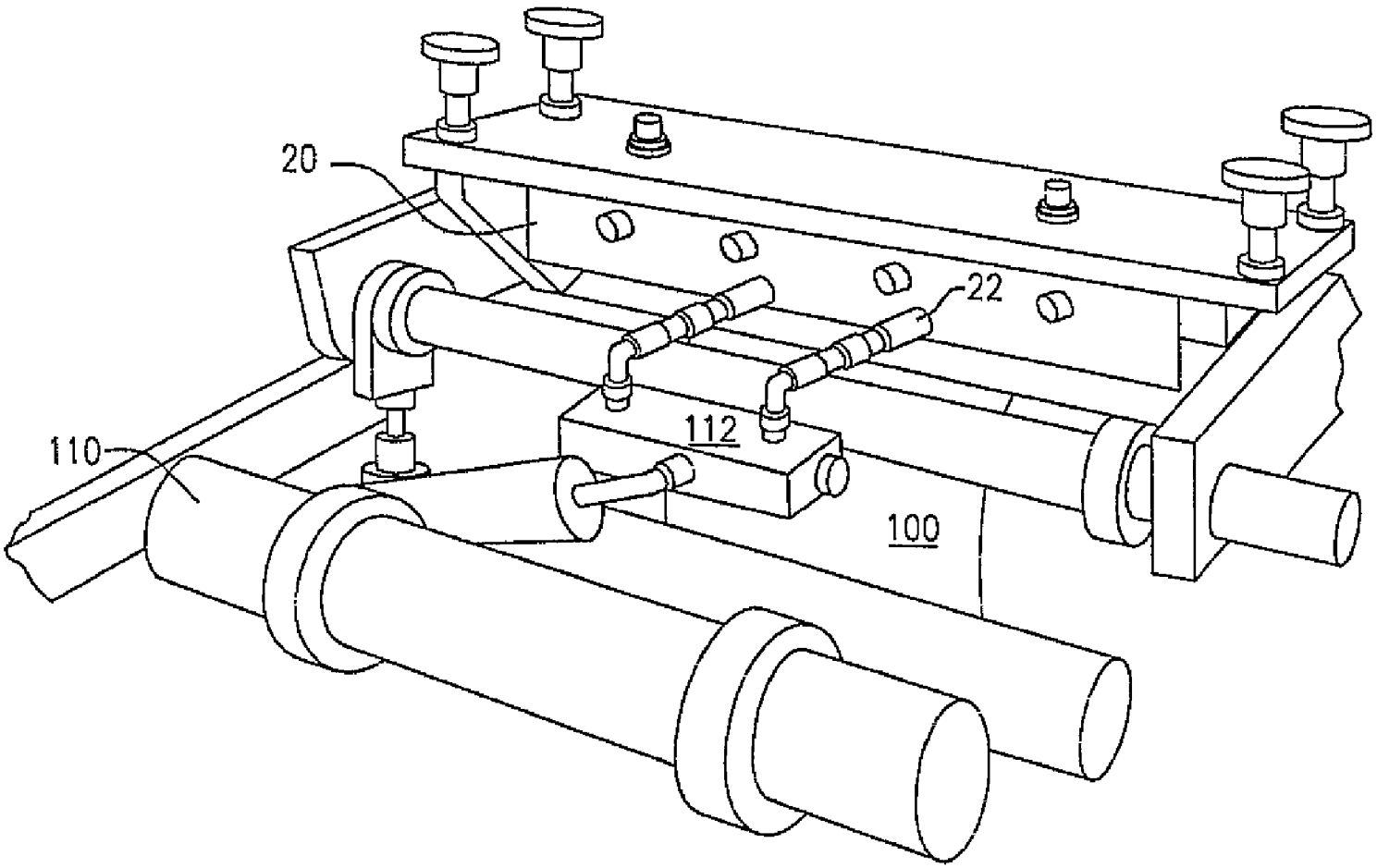
FIG. 5 is a front perspective view of a coating apparatus used in the inventive method.
Figure 6:
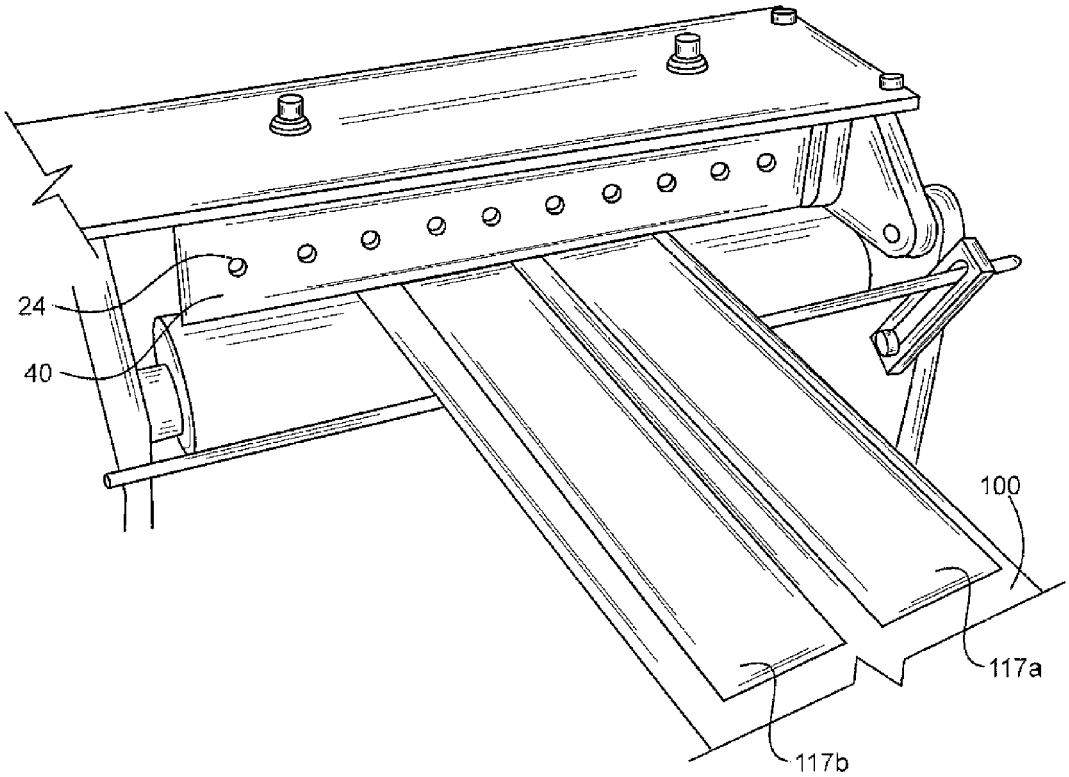
FIG. 6 is a rear perspective view of the coating apparatus of FIG. 5.

More specifically, as best illustrated in FIGS. 5 and 6, substrate 100 is fed into the machinery by rollers 110. Liquid enamel source 112 is attached to inlets 22 so that heated, pressurized liquid enamel can be forced into die 10 When substrate 100 passes under die 10, liquid enamel or other components being coated, fall out of slots 70 and onto substrate 100 thereby forming layer 117 After the nail enamel is applied a second clear layer is applied atop thereto in essentially the same manner as described above.

Prior to applying the liquid enamel, an adhesive coating is applied to substrate 100 The adhesive coating allows for appliqués to selectively adhere to a fingernail Once all of the layers have been applied to substrate 100, and are allowed to dry—a plastic film is applied atop of the nail enamel to preserve and protect the same.

In one preferred embodiment, nail portions are produced in the manner depicted in FIG. 6. As shown, two discrete strips of liquid enamel are applied to substrate 100 forming strips of nail enamel 117*a* and 117*b*. Upon completion of the coating step, the coating is allowed to dry after which Appliqués are cut from each of strips 117*a* 117*b* as described below.

Figure 8:
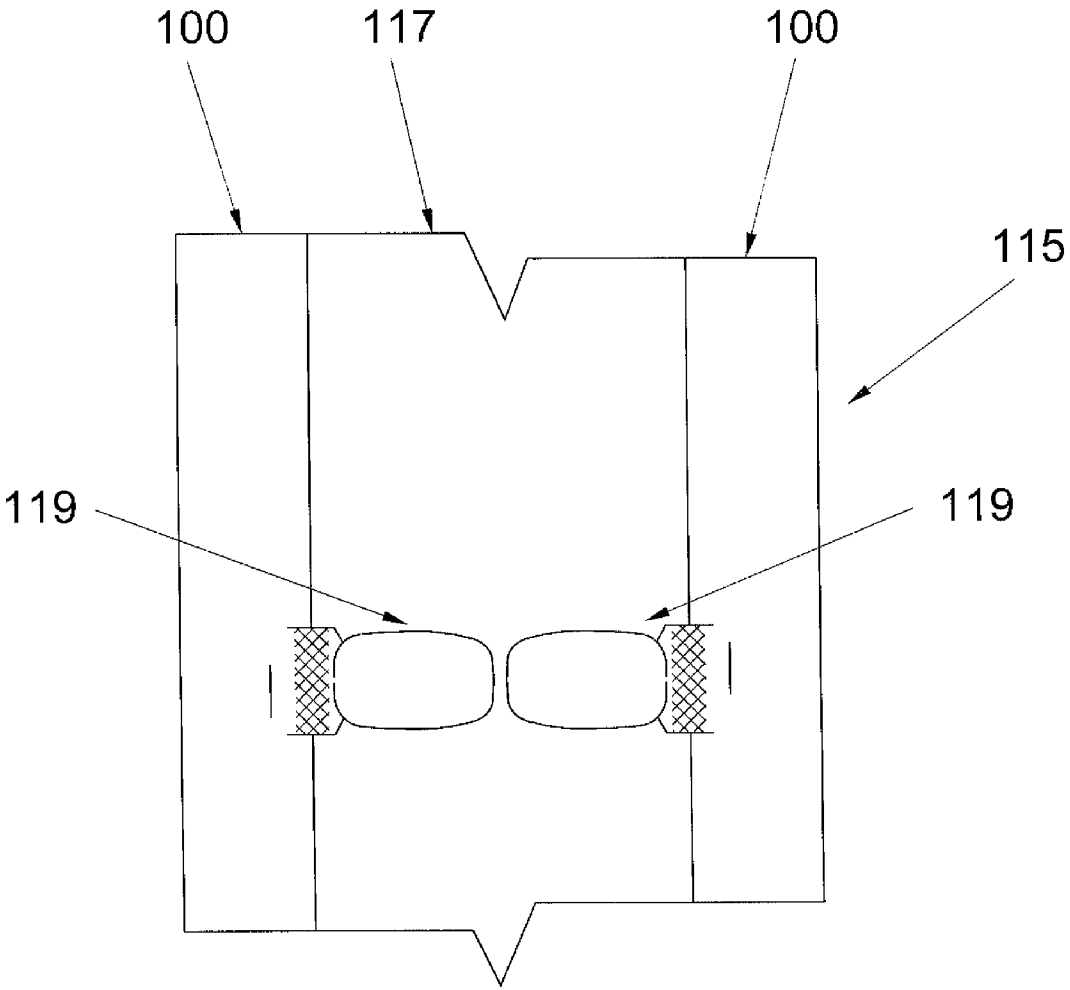
FIG. 8 is a schematic view of a sheet from which a nail appliqué is cut in accordance with an embodiment of the invention.

In FIG. 8, a sheet 115 having a strip of nail enamel 117 is shown from which individual appliqués 119 are cut.

Figure 9:
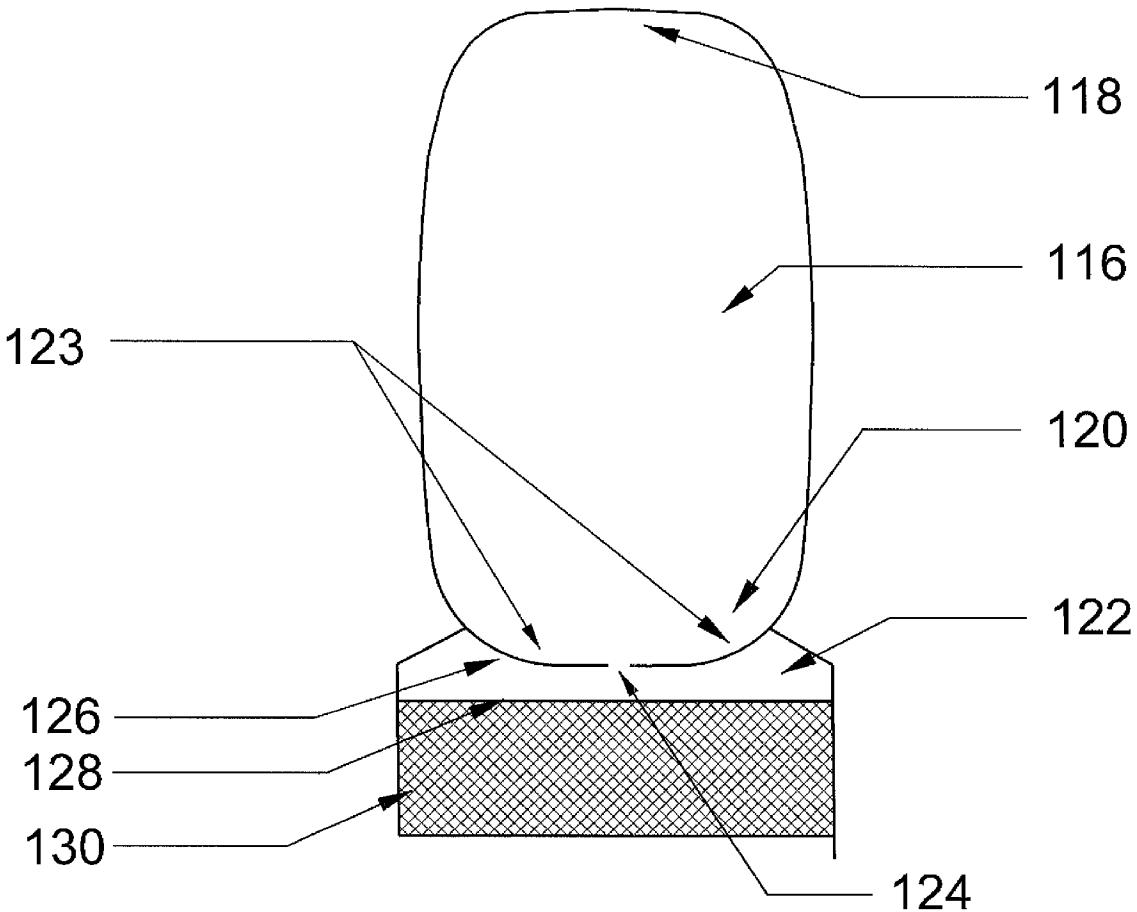
FIG. 9 is a schematic view of a single nail appliqué according to an embodiment of the invention.

As shown in FIG. 9 a single appliqué cut out of sheet 115 comprises a nail coating portion 116 having a first curved end 118 and a second curved end 120. Both curved ends 118 120 are roughly sized and shaped to conform to the contours of a fingernail cuticle. However, each of the curved ends comprises a different curvature. For example, first end 118 comprises an incrementally sharper curve than that of second curved end 120. As such, each of the curved ends are of a different size and can correspondingly coat different sized fingernails.

Attached to second curved end 120 is a buffer section 122. Buffer section 122 is connected to nail section 116 by a slender strip of nail enamel 124 (referred to interchangeably as a "tie" herein). Besides for the tie 124, which joins section 116 with buffer section 122 the two sections are separated by way of a partial cut (kiss cut) 123.

The nail enamel which comprises nail section 116 and buffer section 122 are applied during the coating step as one contiguous coating of nail enamel As can be seen in FIG. 9, a partial cut 123 separates nail section 116 and buffer section 122 It should be noted that only the nail enamel is cut—the under lying substrate 100 is left intact. Importantly, however, section 116 and 122 are not entirely separated by cut 123, rather cut 123 is intentionally incomplete A slender area (tie) 124 of nail enamel is left intact. Tie 124, thus comprises a slender strip of nail enamel that is contiguous with and therefore connects buffer section 122 to nail section 116.

In an embodiment of the invention an appliqué is provided with two or more ties. For example, two ties may be provided in a similar fashion to ties 145 in FIG. 11 whereby ties 145 are disposed on either side of a kiss cut. In a preferred embodiment, tie 124 or ties 145 are at least one thousandth of an inch wide Buffer portion 122 comprises a first end 126 having a tie 124 extending therefrom and a second end 128 having a tape 130 or handling tab extending therefrom. As such, when a user pulls on tab 130 to remove an appliqué from its backing, buffer portion 122 immediately attached thereto is lifted first. If any damage were to occur as a result of stress exerted at or around the area of attachment of tab 130, such damage would be confined to an inconsequential area of the appliqué, i.e. the buffer zone 122.

It will be under stood by those of ordinary skill in the art that in other embodiments a handling tape can be attached directly to the nail section 116 without being mediated by a buffer section.

Once the entire appliqué is removed from its backing, the buffet portion 122 can be easily and neatly removed by gently pulling the nail 116 and buffer portions 122 apart. By so doing, the slender tie 124—being the weakest point on the appliqué—will act as a fault line to localize the tear between the buffer 122 and nail 116 portions.

In an embodiment of the invention, the double-ended appliqués are used in combination with a French tip system. In this embodiment, in addition to a double-ended appliqué for coating a finger nail—a separate section is provided for coating a nail tip.

Figure 7:
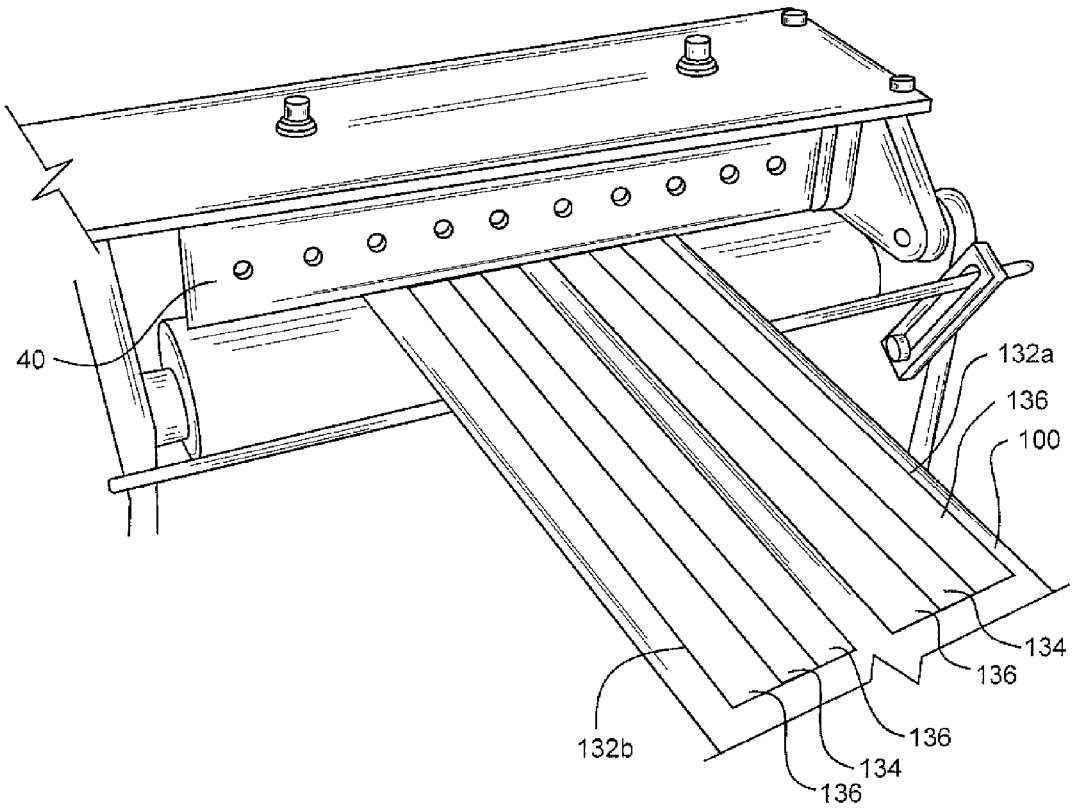
FIG. 7 is a rear perspective view of the coating apparatus of FIG. 5 being used to apply three strips of nail enamel according to an embodiment of the invention.
Figure 10:
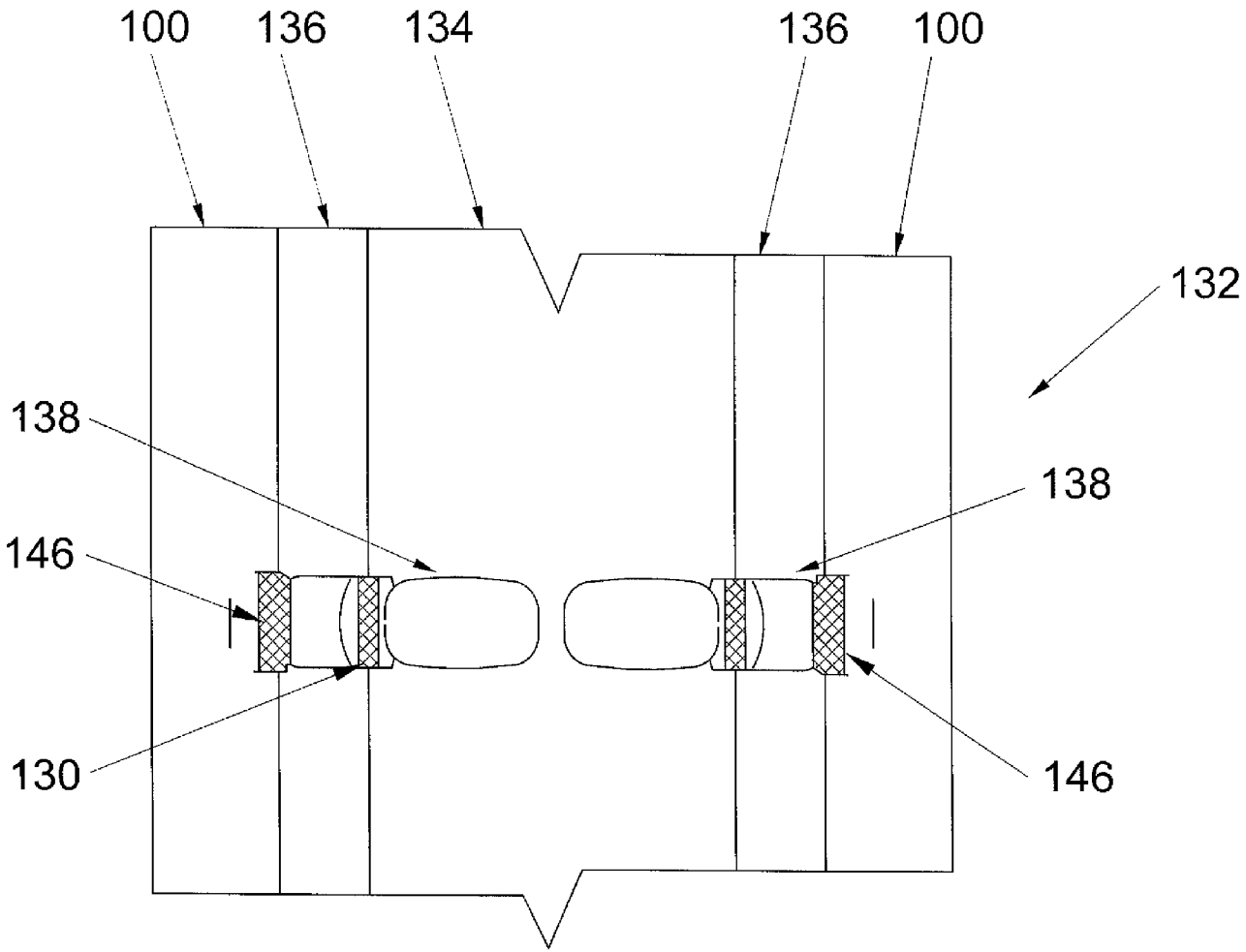
FIG. 10 is a schematic view of a sheet from which a nail appliqué having a French tip is cut in accordance with an embodiment of the invention.

FIG. 10 shows a sheet 132 having three discrete strips of enamel atop of substrate 100—from which French-tip appliqués are cut. The three discrete are applied, as seen in FIG. 7 during the coating step. A center strip 134 is of one color (e.g. pink) and two outer strips 136 are of a different color (e.g. white). Strips 134 and 136 may be applied by two separate coating dies, but more preferably, a single coating die is utilized. Note that in FIG. 7, two separate sheets 132*a* 132*b* are simultaneously created from which appliqués are cut. More specifically, sheet 132 in FIG. 10 is an enlarged view of either 132*a* or 132*b* in FIG. 7

As shown, an oblong cut, extending through strips 134 and 136 is made through sheet 132 in order to produce appliqué 138.

Figure 11:
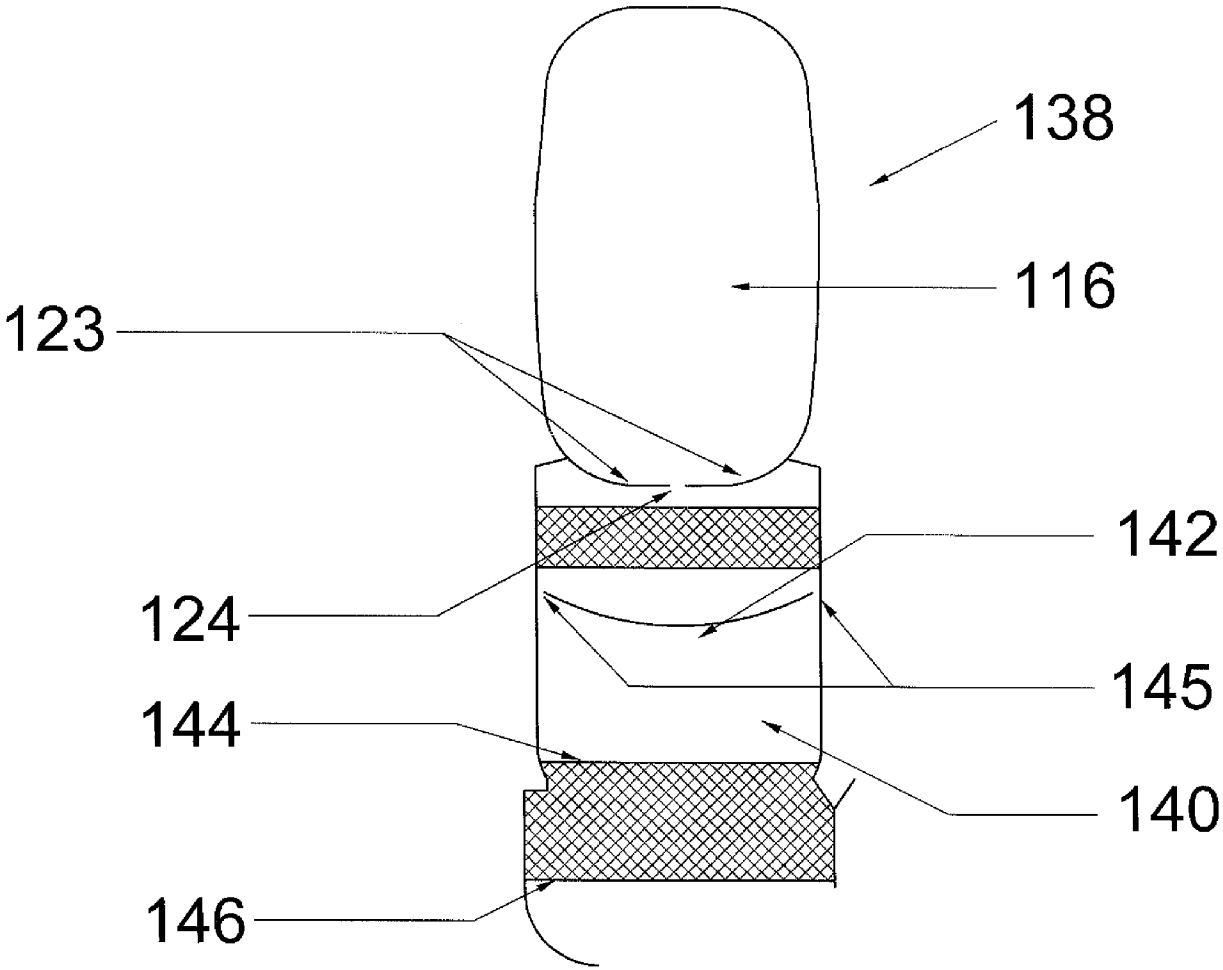
FIG. 11 is a schematic view of a single nail appliqué having a nail section and a nail tip section according to an embodiment of the invention.

FIG. 11 shows an enlarged individual appliqué 138 having a double-ended nail coating section 116. The nail coating section 116 is the same as the one previously described and its description will not be repeated here. In the French tip embodiment, in addition to nail section 116, a nail tip section 140 is provided. The nail coating section 116 is cut out of strip 134, whereas the nail tip section 140 is cut out of strip 136.

Nail tip section 140 comprises a first rounded or crescent-shaped end 142 and a second end 144, which comprises a tab 146 extending therefrom. Rounded end 142 is sized and shaped to roughly conform to the rounded contour of a nail tip. Rounded end 142 is a partial cut through the nail enamel—leaving the underlying substrate intact.

It should be noted that ties 145 are not provided for the same considerations as tie 124. Rather, because a plastic film is applied to a sheet (e.g. 115, 132) prior to cutting out appliqués, if cut 142 were to extend across the entire width of the appliqué, the plastic cover would be severed. Instead, two slender strips 145 are left intact allowing for the plastic covering to remain intact.

Figure 12:
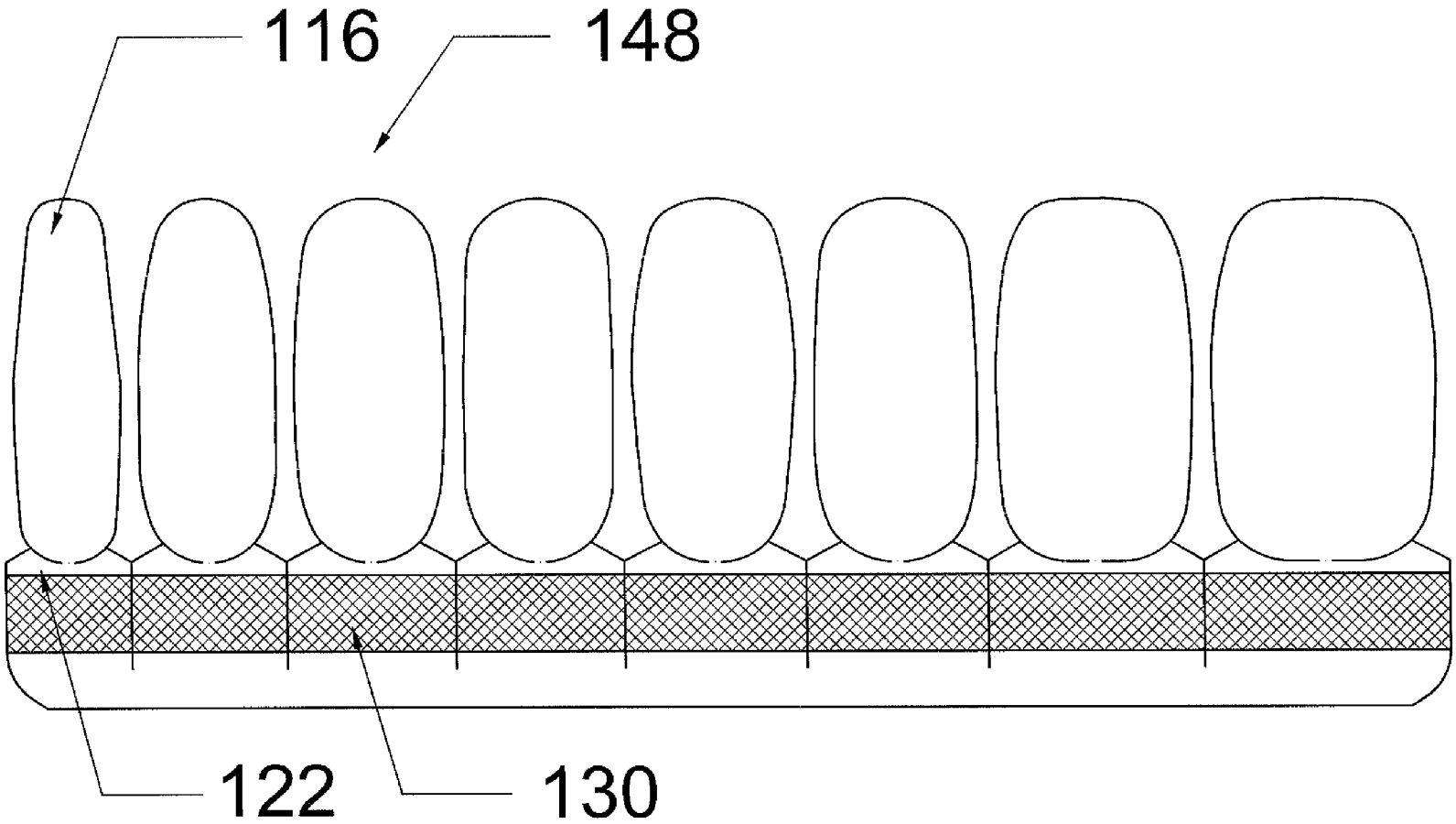
FIG. 12 is a schematic view of a set of nail appliqués according to an embodiment of the invention.

FIG. 12 shows a set 148 of double-ended appliqués. As shown, appliqués are cut to be sized and shaped to toughly correspond to the size and shape of respective fingernails. Set 148 comprises a set of appliqués for coating five fingers There are eight appliqués each having two different sized usable ends. As such, a user is presented with 16 different sizes of appliqués for coating her five fingers. This significantly improves the range of possible sizes of fingernails that can be coated with the inventive product.

Figure 13:
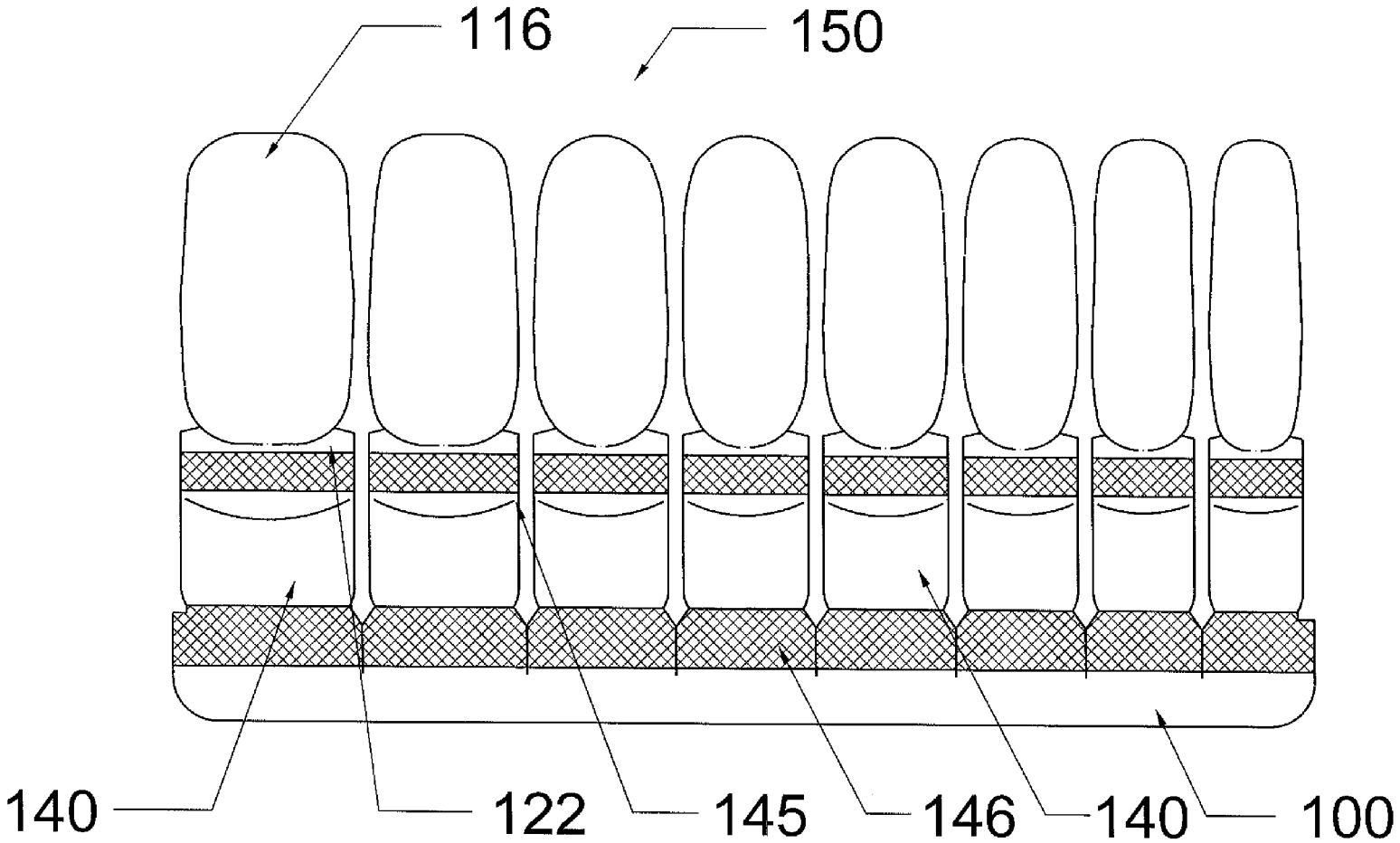
FIG. 13 is a schematic view of a set of nail appliqués having nail sections and tip sections according to an embodiment of the invention.

FIG. 13 shows a set 150 of double-ended nail appliqués which are provided with French nail tip appliqués.

In use, a user removes the protective plastic film from the set of appliqués She then grasps and pulls tab 130 to remove a single appliqué from substrate 100. Holding the tab 130 with buffer section 122 still attached, she gently pulls buffer section 122 and nail section 116 apart. The buffer section 122 is discarded. Having removed buffer section 122 a user is left grasping a double-ended nail portion. She then is able to put either side against her fingernail—without yet securing it thereto—in order to measure which side is best sized to the particular nail to be coated Note that if neither of the sides are suitable, an appliqué within the set that is incrementally larger or smaller may be selected.

Once a suitable appliqué is selected it is placed on the fingernail and pressure is exerted to cause the appliqué to adhere to the fingernail Any excess material is then sheered off.

For applying a French manicure the above steps are taken, but prior thereto a nail tip appliqué 140 is applied to the nail tip. Tip appliqué 140 is removed from substrate and placed at a desired location on the tip of a nail. The tip appliqué is then pressed to cause it to adhere to the nail tip and the excess material removed. The nail section 116 is applied atop thereto. Note that the French tip 140 may be applied after applying nail section 116.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A self adhesive nail appliqué product comprising:

a substrate;

a dry nail enamel nail section disposed on said substrate wherein said nail section comprises a first curved end and a second curved end, each of said first end and second end having a different curvature, whereby each of said first end and second end are roughly sized and shaped to conform to the contours of a fingernail cuticle; a buffer section comprised of dry nail enamel attached to said second curved end of said nail section, said buffer section comprising a first end and a second end, said first end of said buffer section comprising a partial cut enabling separation of said buffer section from said nail section, said first end of said buffer section further comprising a tie for connecting said first end of said buffer section to said second curved end of said nail section, said tie comprising nail enamel that is contiguous with said nail section; and a handling tab extending from said second end of said buffer section, whereby said buffer section is disposed between said nail section and said handling tab.

2. The product of claim 1, wherein said tie is at least one thousandth of an inch wide.

3. The product of claim 1 further comprising a nail tip section said nail tip section comprising a first and second end, said first end being curved and shaped to substantially conform to a contour of a nail tip.

4. The product of claim 3, wherein said curved end comprises a cut through said dry nail enamel.

5. The product of claim 3 further comprising a handling tab extending from said second end.

* * * * *